US012808181B2

(12) United States Patent
Watanabe et al.

(10) Patent No.: US 12,808,181 B2
(45) Date of Patent: Nov. 24, 2026

(54) DRAINING MEMBER AND BUILDING

(71) Applicant: Sekisui House, Ltd., Osaka (JP)

(72) Inventors: Masaki Watanabe, Osaka (JP); Toshiyuki Osada, Osaka (JP)

(73) Assignee: Sekisui House, Ltd., Osaka (JP)

( * ) Notice: Subject to any disclaimer, the term of this patent is extended or adjusted under 35 U.S.C. 154(b) by 239 days.

(21) Appl. No.: 18/267,302

(22) PCT Filed: Dec. 17, 2020

(86) PCT No.: PCT/JP2020/047223
§ 371 (c)(1),
(2) Date: Jun. 14, 2023

(87) PCT Pub. No.: WO2022/130581
PCT Pub. Date: Jun. 23, 2022

(65) Prior Publication Data
US 2024/0044129 A1 Feb. 8, 2024

(51) Int. Cl.
*E04B 1/64* (2006.01)

(52) U.S. Cl.
CPC ..... *E04B 1/64* (2013.01)

(58) Field of Classification Search
CPC . E04B 1/64; E04B 1/003; E06B 1/702; E04D 2013/1422
See application file for complete search history.

(56) References Cited

U.S. PATENT DOCUMENTS

| | | | | |
|---|---|---|---|---|
| 6,676,779 | B2 | 1/2004 | Hopkins et al. | |
| 7,059,087 | B2 * | 6/2006 | Allen | E06B 1/62 52/302.1 |
| 7,591,106 | B2 * | 9/2009 | Conlin | E06B 1/62 52/302.6 |
| 7,877,940 | B2 * | 2/2011 | Meeks | E06B 7/16 49/467 |
| 7,877,945 | B2 * | 2/2011 | Eggen | E06B 1/702 52/95 |
| 9,016,017 | B2 * | 4/2015 | Ryden | E04B 1/625 52/220.8 |
| 2008/0005975 | A1 | 1/2008 | Thompson | |

FOREIGN PATENT DOCUMENTS

| | | | |
|---|---|---|---|
| GB | 2 415 442 | A | 12/2005 |
| GB | 2 424 659 | A | 10/2006 |
| GB | 2 474 543 | A | 4/2011 |
| JP | H0-4269239 | A | 9/1992 |

(Continued)

OTHER PUBLICATIONS

International Search Report dated Feb. 9, 2021, in connection with International Application No. PCT/JP2020/047223.

(Continued)

*Primary Examiner* — Brian E Glessner
(74) *Attorney, Agent, or Firm* — Wolf, Greenfield & Sacks, P.C.

(57) ABSTRACT

A flashing member is arranged on a building at a section where a first exterior wall joins a second exterior wall. The second exterior wall includes a wall body covered by a cover member. The flashing member is arranged between the wall body and the cover member at the section where the first exterior wall joins the second exterior wall.

4 Claims, 3 Drawing Sheets

(56) References Cited

FOREIGN PATENT DOCUMENTS

| | | | |
|---|---|---|---|
| JP | 2513157 | Y2 | 10/1996 |
| JP | 2004-239022 | A | 8/2004 |
| JP | 2006-348682 | A | 12/2006 |

OTHER PUBLICATIONS

Microfilm of the specification and drawings annexed to the request of Japanese Utility Model Application No. 005317/1979 (Laid-Open No. 107501/1980) (National Housing Materials Co., Ltd.) Jul. 28, 1980 (Jul. 28, 1980) entire text; all drawings.
AU 2020476356, Aug. 16, 2023, Australian Examination Report.
Australian Examination Report dated Aug. 16, 2023, in connection with Australian Application No. 2020476356.
[No Author Listed], Wall Flashing Details. Building Advisor.com. Aug. 29, 2020. URL: https://buildingadvisor.com/wall-flashing-details [last accessed Sep. 5, 2023}.

* cited by examiner

DRAINING MEMBER AND BUILDING

CROSS REFERENCE TO RELATED APPLICATIONS

This Application is a national stage filing under 35 U.S.C. 371 of International Patent Application Serial No. PCT/JP2020/047223, filed Dec. 17, 2020, entitled "DRAINING MEMBER AND BUILDING." The entire content of this application is incorporated herein by reference in its entirety.

TECHNICAL FIELD

The present invention relates to a flashing member and a building including the flashing member.

BACKGROUND ART

Patent Document 1 discloses a trough that holds a damp-proof membrane.

A damp-proof membrane is arranged on the foundation of a building. A concrete floor is built on the foundation over the damp-proof membrane. A block wall is arranged adjacent to the concrete floor. The damp-proof membrane is arranged along a first layer of blocks of the block wall. The trough is attached to the blocks to hold the damp-proof membrane to the blocks.

CITATION LIST

Patent Literature

Patent Literature 1: UK Patent Application Publication No. 2415442

SUMMARY OF INVENTION

Technical Problem

A building has a section where two exterior walls join. The joining section is where the flow of rainwater changes course and is vulnerable to deterioration. The structure of the section where two exterior walls join has room for improvement in terms of water resistance.

Solution to Problem (1) A flashing member is arranged on a building at a section where a first exterior wall joins a second exterior wall that includes a wall body covered by a cover member. The flashing member is arranged between the wall body and the cover member at the section where the first exterior wall joins the second exterior wall.

With this structure, the flashing member is arranged between the wall body and the cover member of the second exterior wall at the section where the first exterior wall joins the second exterior wall. This allows the flashing member to receive rainwater that flows along the first exterior wall toward the second exterior wall and avoids deterioration at the section where the first exterior wall joins the second exterior wall.

(2) The flashing member described in (1), including a body configured to extend along the wall body of the second exterior wall and a guide arranged on the body. The body includes a first edge that is arranged near the first exterior wall and a second edge that is arranged at a position that is farther than the first edge from the first exterior wall. The guide extends along the second edge of the body. With this structure, the guide dams rainwater received by the flashing member. This avoids a situation in which the rainwater spreads over the entire second exterior wall.

(3) The flashing member described in (2), further including a second guide that differs from a first guide that serves as the guide. The body of the flashing member is configured to extend along an upper surface of the wall body of the second exterior wall. The second guide extends from the first edge toward the second edge on the body and is configured to form an opening between the first guide and the second guide. With this structure, the second guide guides rainwater, received by the flashing member, toward the first guide.

(4) The flashing member according to any one of those described in (1) to (3), further including a vertical wall arranged along the first exterior wall. With this structure, rainwater flowing along the first exterior wall is guided to the flashing member.

(5) A building including the flashing member according to any one of those described in (1) to (4).

This structure limits deterioration at the section where the first exterior wall joins the second exterior wall. This improves the durability of the building.

Advantageous Effects of Invention

The water resistance of the section where two exterior walls join is improved.

DESCRIPTION OF EMBODIMENTS

A building will now be described with reference to FIGS. 1 to 6.

Figure 1:
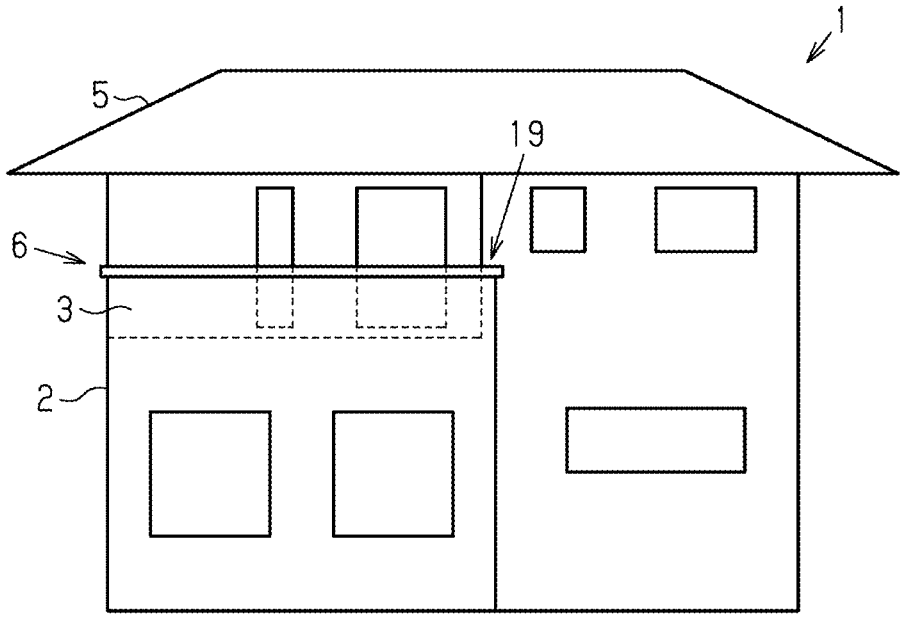
FIG. 1 is a front view of a building.
Figure 2:
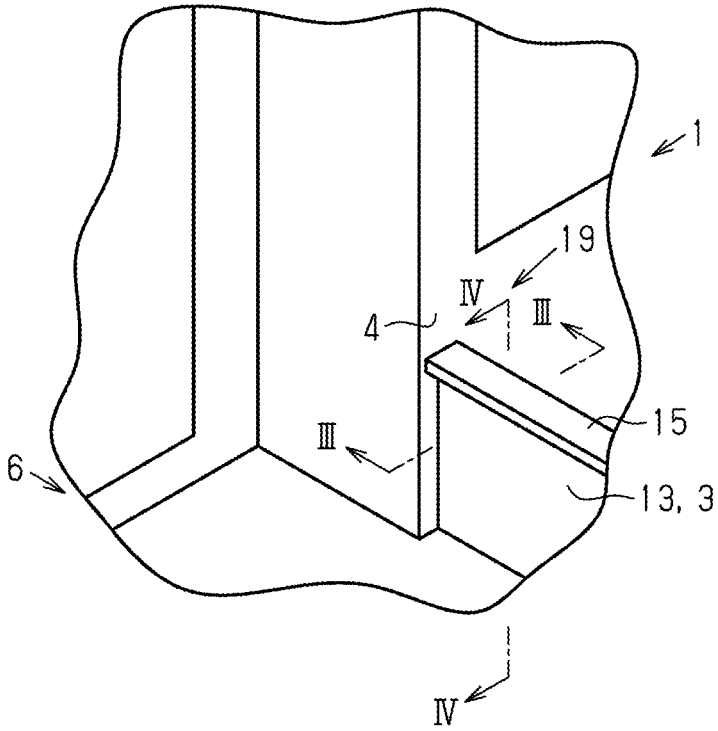
FIG. 2 is a perspective view of a section where a first exterior wall joins a second exterior wall of a building.

As shown in FIGS. 1 and 2, a building 1 includes a building body 2 and a parapet 3. The building body 2 includes a first exterior wall 4, a roof 5, and a roof balcony 6. The parapet 3 is arranged on least one of the roof balcony 6, a balcony, a veranda, and a flat roof. In the present embodiment, the parapet 3 is arranged on the roof balcony 6.

Figure 4:
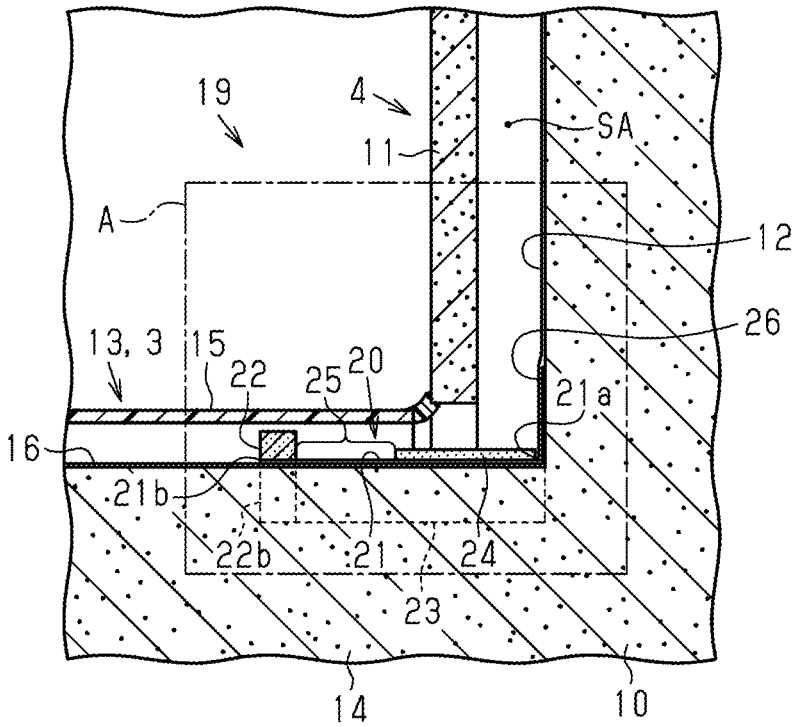
FIG. 4 is a cross-sectional view of the building taken along line IV-IV in FIG. 2.

As shown in FIG. 4, the first exterior wall 4 of the building 1 includes a wall body 10, an exterior member 11 installed on the wall body 10 by furring strips, and a waterproof sheet 12 arranged along the wall body 10. A first gap SA for ventilation extends between the wall body 10 and the exterior member 11.

The parapet 3 includes a second exterior wall 13 that extends and joins the first exterior wall 4.

Figure 3:
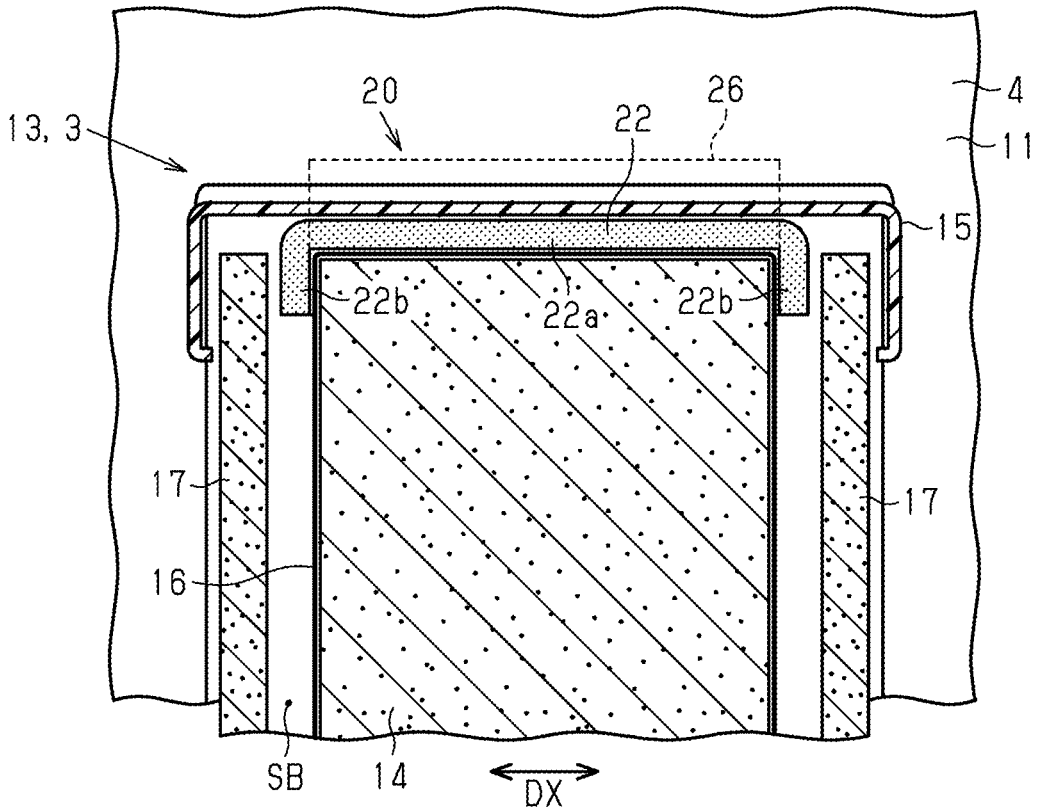
FIG. 3 is a cross-sectional view of the building taken along line III-III in FIG. 2.

As shown in FIG. 3, the second exterior wall 13 includes a wall body 14 and a cover member 15 arranged to cover the wall body 14. The second exterior wall 13 further includes a waterproof sheet 16 that covers the upper surface and side surfaces of the wall body 14, and exterior members 17 installed on the wall body 14 by furring strips. Second gaps SB for ventilation extend between the wall body 14 and the exterior members 17.

The second exterior wall 13 is arranged on the edge of the roof balcony 6 at portions other than where the first exterior wall 4 is arranged and where windows are arranged. The roof balcony 6 is surrounded by the first exterior wall 4, the windows, and the second exterior wall 13. The parapet 3 also includes a flashing member 20.

As shown in FIGS. 3 and 4, the flashing member 20 is arranged at a section 19 of the building 1 where the first exterior wall 4 joins the second exterior wall 13. Specifically, the flashing member 20 is arranged between the wall body 14 and the cover member 15 in the vertical direction. The flashing member 20 is concealed by the cover member 15.

Figure 5:
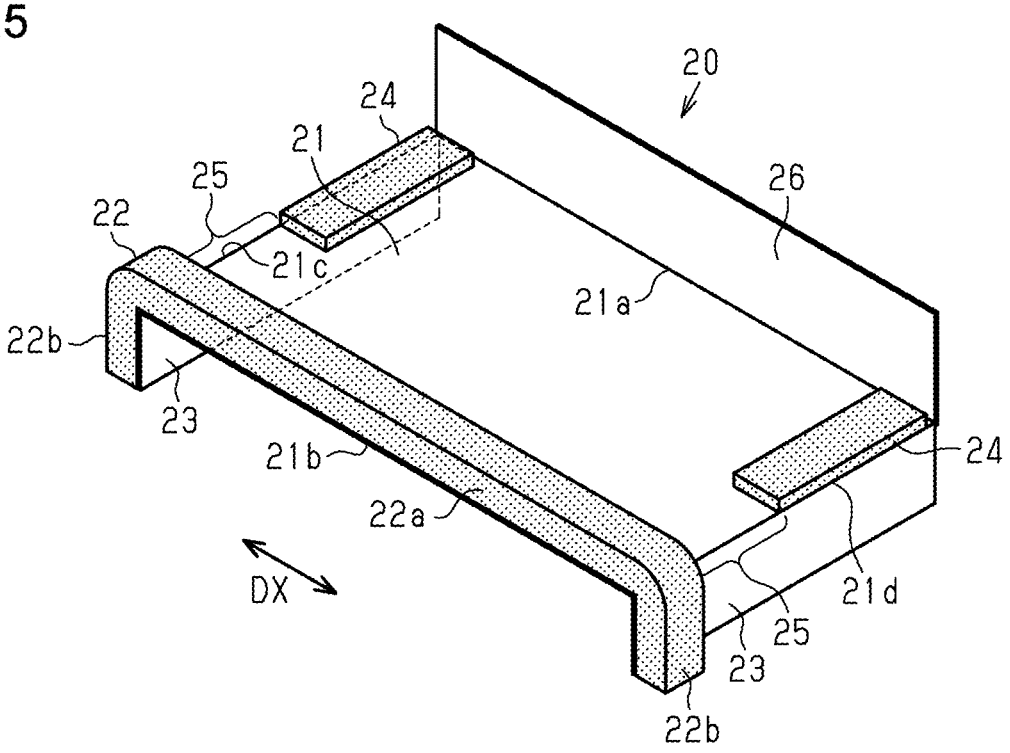
FIG. 5 is a perspective view of a flashing member.

As shown in FIG. 5, the flashing member 20 includes a body 21 and a first guide 22. In the present embodiment, the lateral width of the flashing member 20 is the width in a lateral direction DX. The lateral direction DX coincides with the width direction of the second exterior wall 13 when the flashing member 20 is arranged on the second exterior wall 13.

The body 21 is made of plastic or metal. In one example, the body 21 is made of a steel plate. The body 21 is configured to extend along the upper surface of the wall body 14 of the second exterior wall 13. The width of the body 21 is equal to or slightly greater than the width of the wall body 14 of the second exterior wall 13. The body 21 is rectangular. The body 21 includes a first edge 21*a*, a second edge 21*b*, a third edge 21*c* orthogonal to the first edge 21*a* and the second edge 21*b*, and a fourth edge 21*d* opposed to the third edge 21*c*.

When the flashing member 20 is arranged on the wall body 14 of the second exterior wall 13, the first edge 21*a* is arranged near the first exterior wall 4 (refer to FIG. 4). In this case, the second edge 21*b* is arranged at a position that is farther than the first edge 21*a* from the first exterior wall 4.

As shown in FIG. 5, the flashing member 20 may also include two sides 23 extending from the body 21. One of the two sides 23 extends downward from the third edge 21*c*, and the other one of the two sides 23 extends downward from the fourth edge 21*d*. The sides 23 extend along the second exterior wall 13 when the flashing member 20 is arranged on the second exterior wall 13.

The first guide 22 is made of plastic or metal. In one example, the first guide 22 is formed by an ethylene-propylene-diene rubber foam tape. The first guide 22 is arranged on the upper surface of the body 21.

The first guide 22 extends along the second edge 21*b* of the body 21. In one example, the first guide 22 is longer than the width of the second edge 21*b*. The first guide 22 includes two ends 22*b* that are bent downward at the ends of the second edge 21*b*.

The two ends 22*b* of the first guide 22 are arranged in the second gaps SB between the wall body 14 and the exterior members 17 of the second exterior wall 13 (refer to FIG. 3). A central portion 22*a* of the first guide 22 dams rainwater that flows along the body 21. The ends 22*b* of the first guide 22 guide rainwater, flowing near the second edge 21*b* of the body 21, to the side surfaces of the wall body 14 of the second exterior wall 13.

The flashing member 20 may include second guides 24. The second guides 24 are made of plastic or metal. In one example, the second guides 24 are formed by ethylene-propylene-diene rubber foam tapes.

As shown in FIG. 5, the second guides 24 extend on the body 21 from the first edge 21*a* toward the second edge 21*b*. For example, two second guides 24 are arranged on the body 21. One of the second guides 24 is arranged along the third edge 21*c* of the body 21. The other one of the second guides 24 is arranged along the fourth edge 21*d* of the body 21.

Each second guide 24 is configured to form an opening 25 between the first guide 22 and the second guide 24. The opening 25 is a drain outlet for rainwater received by the flashing member 20.

The thickness of the second guide 24 is set such that the second guide 24 is inserted into a gap between the exterior member 11 of the first exterior wall 4 and the wall body 14 of the second exterior wall 13 at the section 19 where the first exterior wall 4 joins the second exterior wall 13. The second guide 24 may be configured to contact or not to contact the lower surface of the exterior member 11 of the first exterior wall 4.

As shown in FIG. 5, the flashing member 20 may further include a vertical wall 26. The vertical wall 26 extends vertically from the first edge 21*a*. When the flashing member 20 is arranged on the wall body 14 of the second exterior wall 13, the vertical wall 26 is arranged along the first exterior wall 4. Specifically, the vertical wall 26 is arranged between the wall body 10 and the waterproof sheet 12 of the first exterior wall 4 (refer to FIG. 4).

Figure 6:
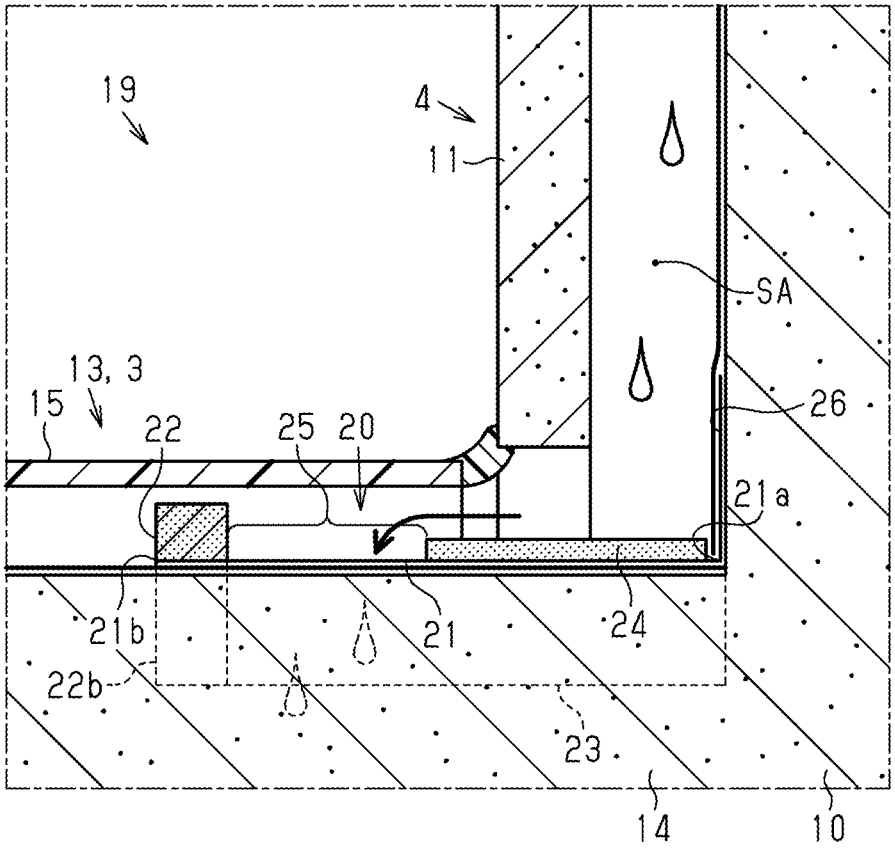
FIG. 6 is an enlarged view of section A in FIG. 4.

The operation of the present embodiment will now be described with reference to FIG. 6.

When rain falls, rainwater flows downward along the first exterior wall 4. The section 19 where the first exterior wall 4 joins the second exterior wall 13 is susceptible to deterioration. The flashing member 20 is arranged at the section 19 where the first exterior wall 4 joins the second exterior wall 13. Since the flashing member 20 is concealed by the cover member 15 of the second exterior wall 13, the flashing member 20 does not adversely affect the design feature of the section 19 where the first exterior wall 4 joins the second exterior wall 13. The first gap SA extends between the wall body 10 and the exterior member 11 of the first exterior wall 4. Rainwater may flow into the first gap SA. The rainwater that flows into the first gap SA is received by the flashing member 20, which is arranged at the section 19 where the first exterior wall 4 joins the second exterior wall 13. This avoids a situation in which rainwater directly strikes the section 19 where the first exterior wall 4 joins the second exterior wall 13 and limits deterioration of the section 19.

The second guides 24 guide the rainwater on the flashing member 20 to the first guide 22. In this manner, the flashing member 20 guides the rainwater away from the section 19 where the first exterior wall 4 joins the second exterior wall 13. This limits deterioration, caused by the flow of water, at the section 19 where the first exterior wall 4 joins the second exterior wall 13. The rainwater that reaches the first guide 22 flows through the openings 25 between the first guide 22 and the second guides 24 into the second gaps SB between the wall body 14 and the exterior members 17 of the second exterior wall 13. This avoids the overflow of rainwater from the gap under the lower end surface of the exterior member 11 of the first exterior wall 4 during heavy rain at the section 19 where the first exterior wall 4 joins the second exterior wall 13.

The present embodiment has the following advantages.

(1) The flashing member 20 is arranged at the section 19 where the first exterior wall 4 joins the second exterior wall 13. The flashing member 20 is arranged between the wall body 14 and the cover member 15 at the section 19 where the first exterior wall 4 joins the second exterior wall 13.

With this structure, the flashing member 20 is arranged between the wall body 14 and the cover member 15 of the second exterior wall 13 at the section 19 where the first exterior wall 4 joins the second exterior wall 13. This allows the flashing member 20 to receive rainwater that flows along the first exterior wall 4 toward the second exterior wall 13 and avoids deterioration at the section 19 where the first exterior wall 4 joins the second exterior wall 13. Further, since the flashing member 20 is concealed by the cover member 15, the flashing member 20 does not adversely affect the appearance of the section 19 where the first exterior wall 4 joins the second exterior wall 13.

(2) The flashing member 20 includes the body 21 and the first guide 22 arranged on the body 21. The body 21 includes the first edge 21*a*, arranged near the first exterior wall 4, and the second edge 21*b*. The second edge 21*b* is arranged at a position that is farther than the first edge 21*a* from the first exterior wall 4. The first guide 22 extends along the second edge 21*b* of the body 21. With this structure, the first guide 22 dams rainwater received by the flashing member 20. This avoids a situation in which the rainwater spreads over the entire second exterior wall 13.

For example, in a structure in which rainwater spreads over the entire second exterior wall 13, the rainwater may enter holes formed in folded portions of the waterproof sheet 16. Thus, the location of the openings 25 through which the rainwater received by the flashing member 20 is discharged is determined in advance.

(3) The flashing member 20 further includes the second guides 24. Each second guide 24 extends from the first edge 21*a* toward the second edge 21*b* on the body 21 and forms the opening 25 between the first guide 22 and the second guide 24. With this structure, the second guide 24 guides rainwater, received by the flashing member 20, toward the first guide 22.

(4) The flashing member 20 further includes the vertical wall 26 arranged along the first exterior wall 4. With this structure, rainwater flowing along the first exterior wall 4 is guided to the flashing member 20. The vertical wall 26 is installed along the first exterior wall 4 so as to position the flashing member 20.

(5) The building 1 includes the flashing member 20. This structure limits deterioration at the section 19 where the first exterior wall 4 joins the second exterior wall 13. This improves the durability of the building 1.

Modifications

The above embodiment is an example of a form that the flashing member 20 and the building 1 can take and is not intended to limit the forms. The flashing member 20 and the building 1 may take a form that differs from the forms described in the embodiment. Such an example includes a form in which part of the configuration of the embodiment is replaced, modified, or removed and a form in which a new configuration is added to the embodiment. Examples of modifications will now be described.

In the flashing member 20, the first guide 22 may be integrated with the body 21. For example, the body 21 and the first guide 22 may be formed integrally by pressing sheet metal or by performing resin molding.

In the flashing member 20, the second guides 24 may be integrated with the body 21. For example, the body 21 and the second guides 24 may be formed integrally by pressing sheet metal or by performing resin molding.

REFERENCE SIGNS LIST

1 . . . building, 10 . . . wall body, 14 . . . wall body, 15 . . . cover member, 19 . . . section, 20 . . . flashing member, 21 . . . body, 22 . . . first guide, 24 . . . second guide, 25 . . . opening, 26 . . . vertical wall

The invention claimed is:

1. A flashing member arranged on a building at a section where a first exterior wall intersects a second exterior wall that includes a wall body covered by a cover member, the flashing member comprising:

a body configured to extend along the wall body of the second exterior wall; and a guide arranged on the body, wherein:

the flashing member is arranged between the wall body and the cover member at the section where the first exterior wall intersects the second exterior wall, the body includes a first edge that is arranged near the first exterior wall and a second edge that is arranged at a position that is farther than the first edge from the first exterior wall, the body includes a lower surface facing the wall body and an upper surface opposite to the lower surface, the guide extends along the second edge of the body on the upper surface of the body, the second exterior wall is a parapet, the flashing member further comprises two second guides that differ from a first guide that serves as the guide, the first guide and the two second guides protrude upward from the upper surface of the body, the first guide is longer than a width of the second edge, the first guide includes two ends that are bent downward at ends of the second edge, the body includes a third edge orthogonal to the first edge and the second edge, and a fourth edge opposed to the third edge, one of the two second guides is arranged along the third edge of the body, and the other one of the two second guides is arranged along the fourth edge of the body, and the two second guides extend from the first edge toward the second edge on the body and are configured to form openings between the first guide and each of the two second guides.

2. The flashing member according to claim 1, wherein the body of the flashing member is configured to extend along an upper surface of the wall body of the second exterior wall.

3. The flashing member according to claim 1, further comprising:

a vertical wall arranged along the first exterior wall.

4. A building comprising:

the flashing member according to claim 1.

* * * * *